US005871155A

United States Patent [19]

Stockner et al.

[11] Patent Number: 5,871,155

[45] Date of Patent: Feb. 16, 1999

[54] HYDRAULICALLY-ACTUATED FUEL INJECTOR WITH VARIABLE RATE RETURN SPRING

[75] Inventors: Alan R. Stockner, Metamora; Norval J. Wiemken, Dwight, both of Ill.

[73] Assignee: Caterpillar Inc., Peoria, Ill.

[21] Appl. No.: 872,278

[22] Filed: Jun. 10, 1997

[51] Int. Cl.[6] ..... F02M 51/06

[52] U.S. Cl. ..... 239/92; 239/533.9

[58] Field of Search ..... 239/92, 124, 127, 239/88, 96; 267/167, 180

[56] References Cited

U.S. PATENT DOCUMENTS

| | | | |
|---|---|---|---|
| 3,442,451 | 5/1969 | Nagel | 239/96 |
| 3,567,133 | 3/1971 | Gewinner | 239/533 |
| 4,182,492 | 1/1980 | Albert et al. | 239/92 |
| 4,222,358 | 9/1980 | Hofbauer | 239/92 |
| 4,442,978 | 4/1984 | Seifert | 239/453 |
| 4,513,916 | 4/1985 | Skinner | 439/453 |
| 4,768,719 | 9/1988 | Straubel et al. | 239/533 |
| 4,848,668 | 7/1989 | Andrews et al. | 239/533 |
| 5,165,607 | 11/1992 | Stevens | 239/533 |
| 5,413,281 | 5/1995 | Hofmann et al. | 239/533 |
| 5,522,545 | 6/1996 | Camplin et al. | 239/92 |
| 5,597,118 | 1/1997 | Carter | 239/92 |
| 5,641,121 | 6/1997 | Beck et al. | 239/92 |
| 5,709,341 | 1/1998 | Gravos | 239/92 |

*Primary Examiner*—Kevin Weldon
*Attorney, Agent, or Firm*—Michael B. McNeil

[57] ABSTRACT

A hydraulically actuated fuel injector includes an injector body defining an actuation fluid chamber that opens to an actuation fluid drain, an actuation fluid inlet and a piston bore, and further defining a nozzle chamber that opens to a plunger bore and a nozzle outlet. A control valve, positioned in the injector body, has a first position that opens the actuation fluid inlet and closes the actuation fluid drain, and a second position that closes the actuation fluid inlet and opens the actuation fluid drain. A piston, positioned in the piston bore. A plunger, positioned in the plunger bore, is moveable between an upper position and a lower position. A needle valve member, positioned in the nozzle chamber, is moveable between an open position in which the nozzle outlet is open and a closed position in which the nozzle outlet is blocked. A portion of the plunger bore and the plunger define a fuel pressurization chamber that opens to the nozzle chamber. A variable rate return spring biases the piston and plunger toward their retracted positions. The variable rate return spring has a relatively low spring rate when the piston is a first distance away from its retracted position and has a relatively high spring rate when the piston is at a second distance away from its retracted position.

20 Claims, 4 Drawing Sheets

HYDRAULICALLY-ACTUATED FUEL INJECTOR WITH VARIABLE RATE RETURN SPRING

TECHNICAL FIELD

The present invention relates generally to hydraulically-actuated fuel injection systems, and more particularly, to a variable rate return spring for the intensifier piston and plunger of such injection systems.

BACKGROUND ART

Known hydraulically-actuated fuel injection systems and/or components are shown, for example, in U.S. Pat. No. 5,423,484 issued to Zuo on Jun. 13, 1995 and U.S. Pat. No. 5,492,098 issued to Hafner et al. on Feb. 20, 1996. In these hydraulically-actuated fuel injectors, a spring biased needle check opens to commence fuel injection when pressure is raised by an intensifier piston/plunger assembly to a valve opening pressure. The intensifier piston is acted upon by a relatively high pressure actuation fluid, such as engine lubricating oil, when a solenoid driven actuation fluid control valve opens the injector's high pressure inlet. Injection is ended by deactivating the solenoid to release pressure above the intensifier piston. A return spring biases the intensifier piston back to its retracted position upon the release of pressure above the intensifier piston. This in turn causes a drop in fuel pressure causing the needle check to close under the action of its return spring to end injection.

Engineers have observed that engines using these fuel injectors can sometimes exhibit unsteady behavior when operating at idle conditions. This unsteady behavior often reveals itself as an oscillating rpm at idle conditions, which corresponds to when the fuel injectors are commanded to inject their lowest quantity of fuel. Since the injector's solenoid is energized for such a short amount of time at idle conditions, injection quantities can also vary due to the irregular poppet valve motion. In other words, even reliably consistent short on-times at idle conditions can result in variations between injectors due at least in part to tolerance variations in the components in different injectors. Also, small variations in the commanded on-time can itself cause significant variations in injected fuel quantity at idle conditions.

Rail pressure is preferably reduced at idle in order to reduce excess noise and wasted energy that would result from a higher than needed rail pressure. Also, lower rail pressure results in longer on-times for the same fuel quantity to be injected. Hence, longer on-times at idle will naturally desensitize the system to slight variations in commanded on-times. But rail pressure is generally increased at a rated or cold start condition. The stroke distance of the intensifier piston/plunger assembly at idle is much less than the stroke distance at rated or cold start conditions. Hence, it is desirable to minimize the opposing force on the piston exerted by the piston return spring and lower the rail pressure at idle, yet maximize that force at rated or cold start conditions. At rated or cold start conditions it is desired to reset the piston to its retracted position as soon as possible. Also, under colder conditions more piston return spring force is generally needed because of the increased viscosity of the actuation fluid. At idle conditions, even a relatively weak spring can retract the piston in adequate time for a subsequent injection event.

Selecting a piston return spring that exerts an acceptable force at both idle and a rated or cold start condition is an engineering trade off which results in a less than ideal piston return spring force at either condition. Since unsteady engine performance is very undesirable, especially at idle conditions, there is a motivation to make these hydraulically-actuated fuel injectors less sensitive to fluctuations in rail pressure and/or poppet control valve motion variations.

The present invention is directed to overcoming one or more of the problems as set forth above.

DISCLOSURE OF THE INVENTION

In one embodiment of the present invention a hydraulically actuated fuel injector includes an injector body defining a piston bore and a nozzle chamber that opens to a nozzle outlet. A needle valve member, positioned in the nozzle chamber, is moveable between an open position in which the nozzle outlet is open and a closed position in which the nozzle outlet is blocked. A hydraulically actuated fuel pressurization assembly includes a piston positioned in the piston bore and moveable between a retracted position and an advanced position. A variable rate return spring is operably positioned to bias the piston toward its retracted position. The variable rate return spring has a relatively low spring rate when the piston is a first distance away from its retracted position and has a relatively high spring rate when the piston is at a second distance away from its retracted position.

In another embodiment of the present invention, a hydraulically-actuated fuel injector includes an injector body defining an actuation fluid chamber that opens to an actuation fluid drain, an actuation fluid inlet and a piston bore, and further defines a nozzle chamber that opens to a plunger bore and a nozzle outlet. A control valve is positioned in said injector body and has a first position that opens said actuation fluid inlet and closes said actuation fluid drain, and a second position that closes said actuation fluid inlet and opens said actuation fluid drain. A piston is positioned in the piston bore and is moveable between a retracted position and an advanced position. A plunger is positioned in the plunger bore and moveable between an upper position and a lower position. A needle valve member is positioned in the nozzle chamber and is moveable between an open position in which said nozzle outlet is open and a closed position in which said nozzle outlet is blocked. A portion of said plunger bore and said plunger defines a fuel pressurization chamber that opens to the nozzle chamber. A variable rate return spring is operably positioned to bias the piston toward its retracted position. The variable rate return spring has a relatively low spring rate when the piston is a first distance away from its retracted position and has a relatively high spring rate when the piston is at a second distance away from its retracted position.

BEST MODE FOR CARRYING OUT THE INVENTION

Figure 1:
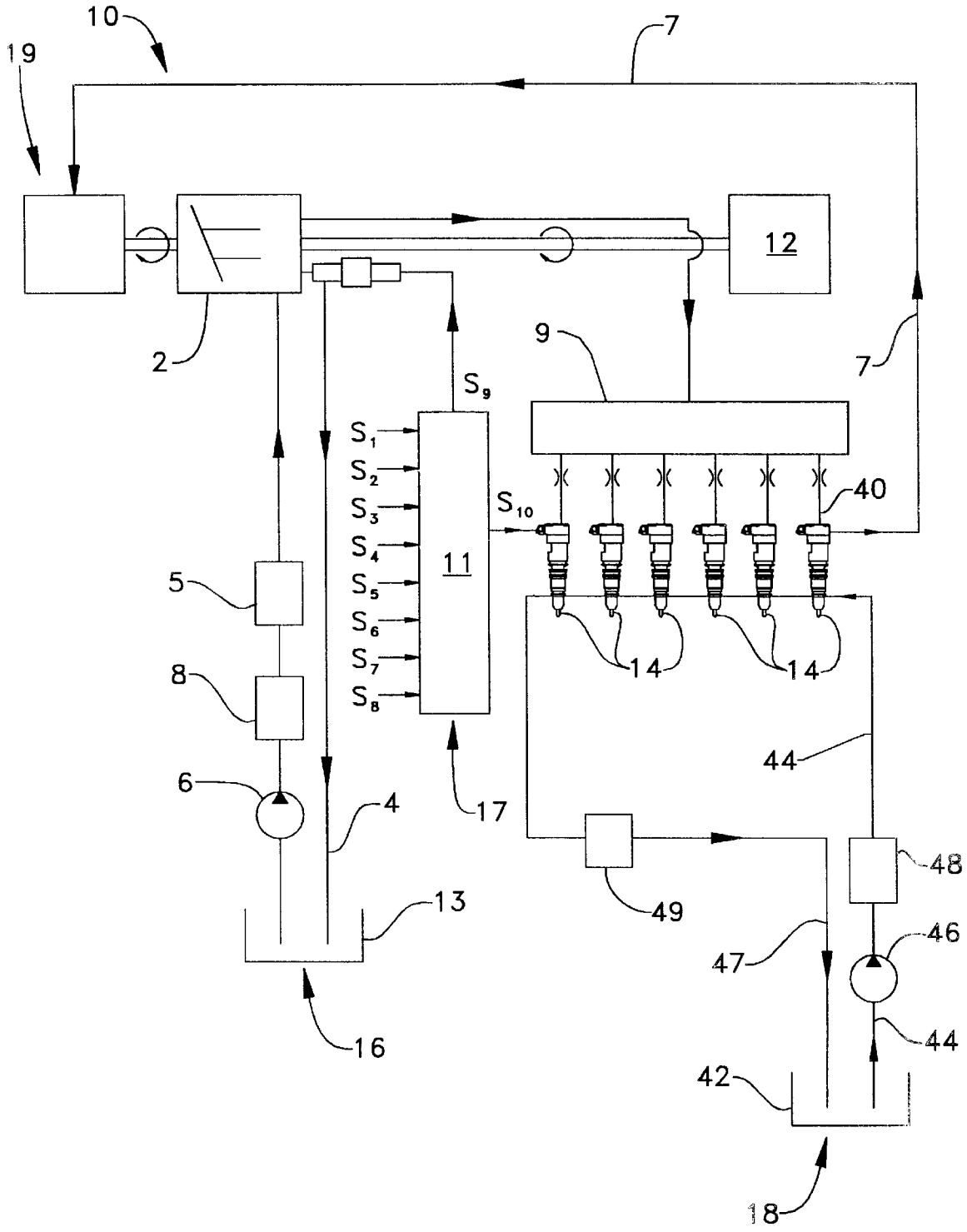
FIG. 1 is a schematic view of a hydraulically-actuated fuel injection system according to the present invention.

Referring now to FIG. 1, there is shown an embodiment of a hydraulically-actuated electronically controlled fuel injection system 10 in an example configuration as adapted for a direct injection diesel cycle internal combustion engine 12. Fuel system 10 includes one or more hydraulically-actuated electronically controlled fuel injectors 14, which are adapted to be positioned in a respective cylinder head bore of engine 12. Fuel system 10 includes an apparatus or means 16 for supplying actuating fluid to each injector 14, an apparatus or means 18 for supplying fuel to each injector, a computer 17 for electronically controlling the fuel injection system and an apparatus or means 19 for recirculating actuation fluid and for recovering hydraulic energy from the actuation fluid leaving each of the injectors.

The actuating fluid supply means 16 preferably includes an actuating fluid sump 13, a relatively low pressure actuating fluid transfer pump 6, an actuating fluid cooler 8, one or more actuation fluid filters 5, a high pressure pump 2 for generating relatively high pressure in the actuation fluid and at least one relatively high pressure common rail 9. Common rail 9 is arranged in fluid communication with the outlet from the relatively high pressure actuation fluid pump 2. A rail branch passage 40 connects the actuation fluid inlet of each injector 14 to the high pressure common rail 9.

Actuation fluid leaving the actuation fluid drain of each injector 14 enters a recirculation line 7 that carries the same to the hydraulic energy recirculating or recovering means 19. A portion of the recirculated actuation fluid is channeled to high pressure actuation fluid pump 2 and another portion is returned to actuation fluid sump 13 via recirculation line 4. Any available engine fluid is preferably used as the actuation fluid in the present invention. However, in the preferred embodiments, the actuation fluid is engine lubricating oil and the actuation fluid sump 13 is an engine lubrication oil sump. This allows the fuel injection system to be connected as a subsystem to the engine's lubricating oil circulation system. Alternatively, the actuation fluid could be fuel provided by a fuel tank 42 or another source, such as coolant fluid, etc.

The fuel supply means 18 preferably includes a fuel tank 42, a fuel supply passage 44 arranged in fluid communication between fuel tank 42 and the fuel inlet of each injector 14. Also included is a relatively low pressure fuel transfer pump 46, one or more fuel filters 48, a fuel supply regulating valve 49, and a fuel circulation and return passage 47 arranged in fluid communication between injectors 14 and fuel tank 42.

A computer 17, which includes an electronic control module 11 contains software decision logic and information defining optimum fuel system operational parameters, and also controls key components of the fuel injection system, including actuation fluid pressure and injector solenoid on-time. Electronic control module 11 receives input data signals from one or more signal indicating devices. For example, input data signals may include engine speed $S_1$, engine crank shaft position $S_2$, engine coolant temperature $S_3$, engine exhaust back pressure $S_4$, air intake manifold pressure $S_5$, hydraulic actuating fluid common rail pressure $S_6$, throttle position or desired fuel setting $S_7$, and transmission operating condition $S_8$. The output control signal $S_9$ is directed to the high pressure pump and controls the pressure of the actuation fluid in the common rail. The control signal $S_{10}$ (solenoid current) controls the injector solenoid on-time and hence the duration of each injection event. Each of the injection parameters are variably controllable independent of engine speed and load.

Figure 2:
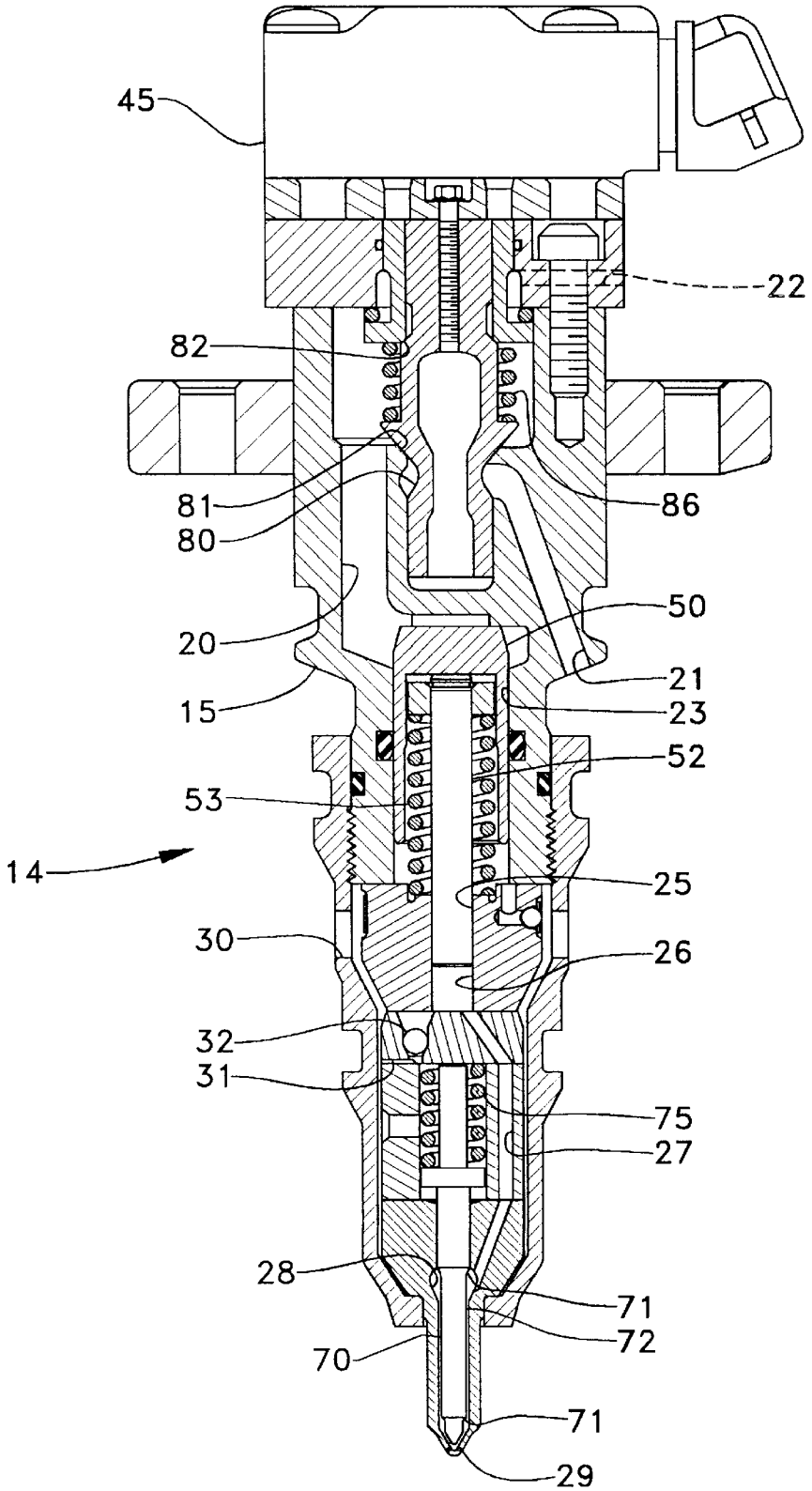
FIG. 2 is a sectioned side elevational view of a fuel injector according to the present invention.

Referring now to FIG. 2, hydraulically-actuated fuel injector 14 includes an injector body 15 made up of various components and containing various bores and passageways. In particular, injector body 15 includes an actuation fluid chamber 20 that opens to a piston bore 23, a high pressure actuation fluid inlet 21 past seat 81 and a low pressure actuation fluid drain 22 past seat 82. When solenoid 45 is energized, poppet valve member 80 lifts against the action of spring 86 to close seat 82 and open seat 81 so that high pressure actuation fluid can flow through inlet 21 past seat 81 and into actuation fluid chamber 20. When solenoid 45 is de-energized, compression spring 86 biases poppet valve member 80 to close seat 81 and open seat 82. Thus, actuation fluid chamber 20 is normally opened to low pressure actuation fluid drain 22 when solenoid 45 is de-energized.

A hydraulically actuated fuel pressurization assembly includes an intensifier piston 50 positioned to reciprocate in piston bore 23 between a retracted position (as shown) and an advanced position. The piston moves downward when its upper hydraulic surface is exposed to high pressure actuation fluid. A return spring 53 maintains a plunger 52 in contact with the underside of intensifier piston 50, and biases both toward their retracted positions, as shown. Plunger 52 is positioned to reciprocate in a plunger bore 25 between a retracted position (as shown) and an advanced position. A portion of plunger bore 25 and plunger 52 define a fuel pressurization chamber 26.

Injector body 15 further includes a nozzle chamber 28 that opens to fuel pressurization chamber 26 via a connection passage 27, and also opens to nozzle outlet 29. A needle valve member 70 is positioned to reciprocate in the nozzle chamber 28 between an open position in which nozzle outlet 29 is open and a closed position in which nozzle outlet 29 is closed. A compression spring 75 normally biases needle valve member 70 to its closed position. When fuel pressure in nozzle chamber 28 exceeds a valve opening pressure sufficient to overcome compression spring 75, the hydraulic force acting on lifting hydraulic surfaces 71 causes needle valve member 70 to lift and open nozzle outlet 29. Needle valve member 29 will remain in its open position for as long as the fuel pressure is sustained above a valve closing pressure, which is usually lower than the valve opening pressure. Fuel enters injector 14 at fuel inlet/return area 30 and circulates along passageway 31 past check ball 32 and into fuel pressurization chamber 26. Ball check 32 prevents the reverse flow of fuel from fuel pressurization chamber 26 back to fuel inlet 31 when plunger 52 is in its downward stroke during an injection event.

Figure 3:
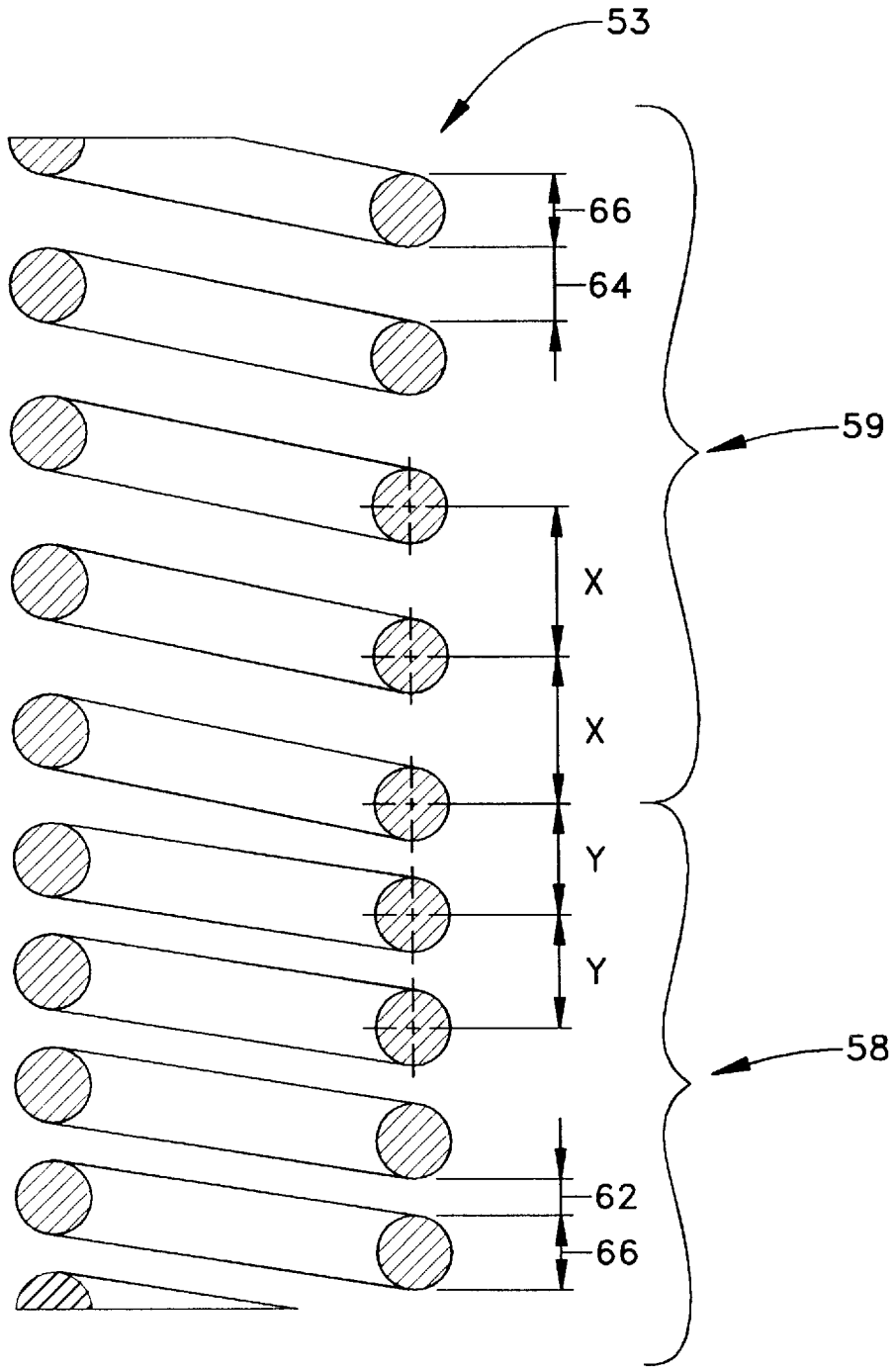
FIG. 3 is an enlarged partial sectioned side elevational view of a variable rate return spring according to one aspect of the present invention.

Referring now in addition to FIG. 3, a close-up side sectional view of a portion of the intensifier piston variable rate return spring 53 is illustrated in its extended position corresponding to the retracted position of piston 50. Spring 53 includes a first set of coils 58 and a second set of coils 59. Distance y, also called a pitch, between the cross-sectional coil centers in first set of coils 58 is smaller than distance or pitch x between the cross-sectional coil centers in second set of coils 59. Since spring wire diameter or radial thickness 66 is the same in either set of coils, a distance between coils 62 in the first set of coils 58 is smaller than distance between coils 64 in the second set of coils 59. First set of coils 58 and second set of coils 59 are joined to form one continuous coil 53.

The force required to compress a spring varies with the coil spacing or pitch. When piston 50 is in the retracted position, variable rate return spring 53 is at maximum extension and the maximum number of coils have gaps 62 and 64 between them. As piston 50 is in the first few millimeters of its stroke from the retracted position (corresponding to an idle condition), coils from first set of coils 58 are pressed together, eliminating gaps 62. Coils from first set of coils 58 are compressed before coils from second set of coils 59 since pitch y between first set of coils 58 is less than pitch x between second set of coils 59, resulting in less opposing force from first set of coils 58 than from second set of coils 59. At idle condition, piston 50 advances only a short distance that is usually less than about 3 millimeters from the retracted position before it retreats back to the retracted position. The sum of gaps 62 between first set of coils 58 is slightly greater than or equal to this short distance, or in this case about 3 millimeters. Piston 50 preferably only has to overcome the resistant force of first set of coils 58 at an idle condition.

At a rated or cold start (i.e., high fuel) condition, piston 50 cycles through its maximum stroke length, which is about 7 millimeters for the example injector illustrated. At about 3 millimeters from the retracted position, piston 50 has fully compressed first set of coils 58, eliminating all gaps 62. At this point piston 50 starts compressing second set of coils 59, which have a greater pitch x than first set of coils 58 and produce a greater resistant force. This greater resistant force is desired in a rated or cold start condition to reset the piston as soon as possible and to overcome the greater viscosity of the actuation fluid at cold temperatures.

The spring rate of spring 53 increases after coils 58 are pressed together, or, in other words, become inactive. As piston 50 advances past about 3 millimeters in a rated or cold start condition, first set of coils 58 become inactive, increasing the spring rate. At idle condition, more coils remain active so that the spring rate and return force is minimized since the only deflection takes place in closely spaced coils 58. Thus, piston 50 encounters less resistance at idle, which permits a lowering of rail pressure to inject an identical quantity of fuel.

Variable rate return spring 53 is shown in this embodiment as a helical coil compression spring. However, it is to be understood that spring 53 could be configured in various other forms. For instance, spring 53 could be a conical coil spring, or the variable spring rate could be accomplished with spring wire having different diameters in different sections of the spring. In the first case, the larger diameter coils would have the lower spring rate and go inactive initially. In the second case, the smaller diameter wire coils would have the low spring rate. The invention could also be accomplished by a variable rate return spring made up of two or more stacked springs having different spring rates.

Industrial Applicability

Figure 4:
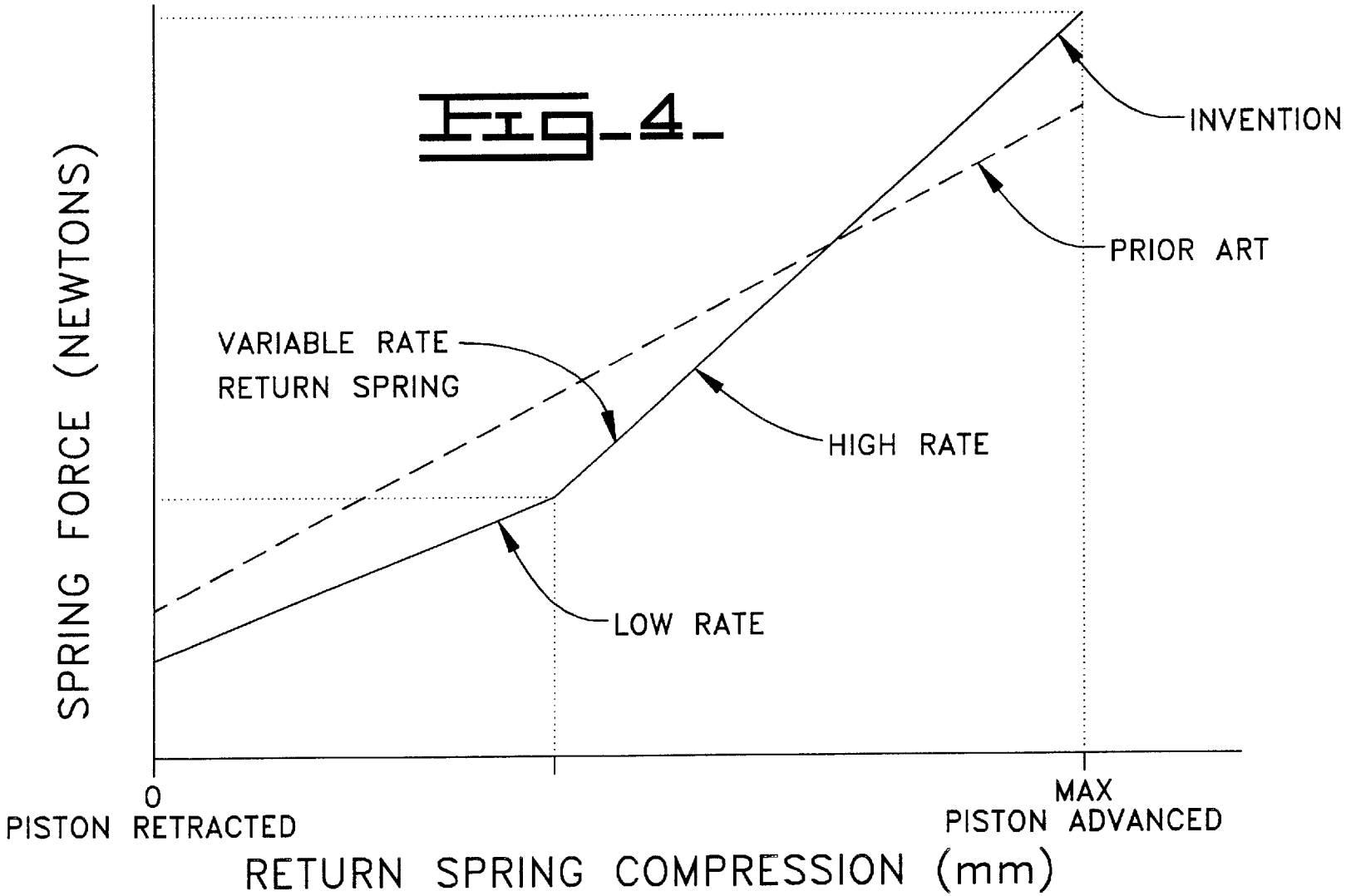
FIGS. 4 is a plot of intensifier piston return spring force, for both a prior art fuel injector having a constant rate return spring and for a fuel injector having a variable rate return spring according to the present invention.

FIGS. 4 shows a graph of intensifier piston return spring force versus millimeters of spring compression for both a prior art constant rate return spring and a variable rate return spring 53 of the present invention. The lower plot, which has two linear segments, represents the variable rate return spring 53. The plot starts at a point where piston 50 is in its retracted position and spring 53 is at maximum extension and minimum compression. In the first 3 millimeters of piston stroke, the more narrowly spaced first set of coils 58 get pressed together and substantially determine the force required to compress spring 53. In FIG. 4, the spring rate during the first three millimeters of compression is about 12 Newtons per millimeter in this example. After the first set of coils 58 are fully pressed together and the resistance of the more widely spaced second set of coils 59 must be overcome for further compression. In FIG. 4, when compression is greater than 3 millimeters and less than 7 millimeters from the retracted piston position, the spring rate is about 54 Newtons per millimeter of compression.

The other line in FIG. 4 represents a conventional prior art constant rate return spring. The spring rate is a compromise between 12 Newtons per millimeter and 54 Newtons per millimeter in the example injector. The spring rates, and hence the spring force at a given spring compression, of both the constant rate spring and the variable rate spring are design choices to be optimized for a particular application. Nevertheless, it is apparent from the graph of FIG. 4 that the variable rate return spring of the present invention produces less spring force at idle conditions than the prior art spring, yet produces more spring return force than the prior art spring at high fuel rated or cold start conditions.

Those skilled in the art will appreciate that the above description is for illustrative purposes only, and is not intended to limit the scope of the invention in any way. For instance, springs other than the coil spring illustrated could be made to have a variable spring rate in accordance with the present invention. In any event, the scope of the invention should be determined in terms of the claims set forth below.

We claim:

1. A hydraulically actuated fuel injector comprising:

an injector body defining a piston bore and a nozzle chamber that opens to a nozzle outlet;

a needle valve member positioned in said nozzle chamber and moveable between an open position in which said nozzle outlet is open and a closed position in which said nozzle outlet is blocked;

a hydraulically actuated fuel pressurization assembly within said injector body that includes a piston positioned in said piston bore and moveable between a retracted position and an advanced position; and a variable rate return spring operably positioned to bias said piston toward said retracted position, and said variable rate return spring having a relatively low spring rate when said piston is a first distance away from said retracted position and having a relatively high spring rate when said piston is at a second distance away from said retracted position.

2. The hydraulically actuated fuel injector of claim 1 wherein said first distance is smaller than said second distance.

3. The hydraulically actuated fuel injector of claim 2 wherein said piston has a stroke distance between said retracted position and said advanced position that is equal to or greater than about seven millimeters; and said first distance is equal to or less than about three millimeters.

4. The hydraulically actuated fuel injector of claim 3 wherein said second distance is greater than about three millimeters and equal to or less than said stroke distance.

5. The hydraulically actuated fuel injector of claim 2 wherein said first distance corresponds to an idle condition.

6. The hydraulically actuated fuel injector of claim 5 wherein said second distance corresponds to a cold start condition.

7. The hydraulically actuated fuel injector of claim 5 wherein said second distance corresponds to a rated condition.

8. The hydraulically actuated fuel injector of claim 2 wherein said variable rate return spring includes a first set of coils that are closer to one another than a remaining set of coils.

9. The hydraulically actuated fuel injector of claim 8 wherein said first set of coils are in contact with one another when said piston is greater than said first distance away from said retracted position.

10. The hydraulically actuated fuel injector of claim 1 wherein said low spring rate is less than about fifteen Newtons per millimeter; and said high spring rate is greater than about fifty Newtons per millimeter.

11. A hydraulically actuated fuel injector comprising:

an injector body defining an actuation fluid chamber that opens to an actuation fluid drain, an actuation fluid inlet and a piston bore, and further defining a nozzle chamber that opens to a plunger bore and a nozzle outlet;

a control valve positioned in said injector body having a first position that opens said actuation fluid inlet and closes said actuation fluid drain, and a second position that closes said actuation fluid inlet and opens said actuation fluid drain;

a piston positioned in said piston bore and moveable between a retracted position and an advanced position;

a plunger positioned in said plunger bore and moveable between an upper position and a lower position;

a needle valve member positioned in said nozzle chamber and moveable between an open position in which said nozzle outlet is open and a closed position in which said nozzle outlet is blocked;

a portion of said plunger bore and said plunger defining a fuel pressurization chamber that opens to said nozzle chamber; and a variable rate return spring operably positioned to bias said piston toward said retracted position, and said variable rate return spring having a relatively low spring rate when said piston is a first distance away from said retracted position and having a relatively high spring rate when said piston is at a second distance away from said retracted position.

12. The hydraulically actuated fuel injector of claim 11 wherein said first distance is smaller than said second distance.

13. The hydraulically actuated fuel injector of claim 12 wherein said injector body includes a fuel inlet connected to a source of fuel; and said actuation fluid inlet is connected to a source of actuation fluid that is different from said source of fuel.

14. The hydraulically actuated fuel injector of claim 12 wherein said piston has a stroke distance between said retracted position and said advanced position that is equal to or greater than about seven millimeters; and said first distance is equal to or less than about three millimeters.

15. The hydraulically actuated fuel injector of claim 12 wherein said first distance corresponds to an idle condition.

16. The hydraulically actuated fuel injector of claim 15 wherein said second distance corresponds to a cold start condition.

17. The hydraulically actuated fuel injector of claim 15 wherein said second distance corresponds to a rated condition.

18. The hydraulically actuated fuel injector of claim 12 wherein said variable rate return spring includes a first set of coils that are closer to one another than a remaining set of coils.

19. The hydraulically actuated fuel injector of claim 18 wherein said first set of coils are in contact with one another when said piston is greater than said first distance away from said retracted position.

20. The hydraulically actuated fuel injector of claim 11 wherein said low spring rate is less than about fifteen Newtons per millimeter; and said high spring rate is greater than about fifty Newtons per millimeter.

* * * * *

UNITED STATES PATENT AND TRADEMARK OFFICE

CERTIFICATE OF CORRECTION

PATENT NO. : 5,871,155

DATED : February 16, 1999

INVENTOR(S) : Alan R. Stockner, et al.

It is certified that error appears in the above-identified patent and that said Letters Patent is hereby corrected as shown below:

Title page, item [57],

In the abstract, the sentence beginning in the 9th line should read "A piston, positioned in the piston bore, is moveable between a retracted position and an advanced position."

Signed and Sealed this

Thirtieth Day of November, 1999

*Attest:*

*Attesting Officer*

Q. TODD DICKINSON

*Acting Commissioner of Patents and Trademarks*